US011359628B2

(12) United States Patent
Song et al.

(10) Patent No.: US 11,359,628 B2
(45) Date of Patent: Jun. 14, 2022

(54) SCROLL COMPRESSOR INCLUDING RETAINING WALL HOUSING ELECTRICAL MACHINERY MECHANISM

(71) Applicant: SHANGHAI HIGHLY NEW ENERGY TECHNOLOGY CO., LTD., Shanghai (CN)

(72) Inventors: Xuefeng Song, Shanghai (CN); Yuqiang Wang, Shanghai (CN); Yingtao Mou, Dalian (CN)

(73) Assignee: SHANGHAI HIGHLY NEW ENERGY TECHNOLOGY CO., LTD., Shanghai (CN)

( * ) Notice: Subject to any disclaimer, the term of this patent is extended or adjusted under 35 U.S.C. 154(b) by 319 days.

(21) Appl. No.: 16/608,334

(22) PCT Filed: Mar. 7, 2018

(86) PCT No.: PCT/CN2018/078314
§ 371 (c)(1),
(2) Date: Dec. 19, 2019

(87) PCT Pub. No.: WO2018/196486
PCT Pub. Date: Nov. 1, 2018

(65) Prior Publication Data

US 2020/0132072 A1 Apr. 30, 2020

(30) Foreign Application Priority Data

Apr. 28, 2017 (CN) ..... 201710294487.2

(51) Int. Cl.
*F04C 18/02* (2006.01)
*F04C 29/04* (2006.01)
(Continued)

(52) U.S. Cl.
CPC ..... *F04C 18/0215* (2013.01); *F04C 29/00* (2013.01); *F04C 29/047* (2013.01);
(Continued)

(58) Field of Classification Search
CPC ..... F04C 2/025; F04C 18/0207–0292; F04C 29/047; F04C 2240/10; F04C 2240/30;
(Continued)

(56) References Cited

U.S. PATENT DOCUMENTS 5,599,178 A * 2/1997 Yuzaki ..... F04C 18/0215 29/888.022
2002/0039532 A1 4/2002 Saito et al.
(Continued)

FOREIGN PATENT DOCUMENTS

CN 1407233 A 4/2003
CN 102588273 A 7/2012
(Continued)

OTHER PUBLICATIONS

The JP1OA issued Sep. 15, 2020 by the JPO.
(Continued)

*Primary Examiner* — Laert Dounis
(74) *Attorney, Agent, or Firm* — Qinghong Xu

(57) ABSTRACT

A compressor comprises a housing including a first opening to form a receiving space and a retaining wall, wherein the receiving space is divided, by the retaining wall, a low-pressure chamber and a controller chamber. A compressing mechanism further comprises a fixed scroll plate including a low-pressure side of scroll wraps and a high-pressure side, opposite to the scroll wraps; an orbiting scroll plate, located in the receiving space, including a side, facing the scroll wraps of the fixed scroll plate, of scroll wraps and a compression chamber is formed by the scroll wraps of the fixed scroll plate and the scroll wraps of the orbiting scroll
(Continued)

plate; an electrical machinery mechanism, located in the low-pressure chamber, including a rotor and a stator, wherein the electrical machinery mechanism drives the compressing mechanism to rotates to compress refrigerant in the compression chamber.

11 Claims, 22 Drawing Sheets

(51) Int. Cl.
*F04C 29/00* (2006.01)
*F04C 29/12* (2006.01)

(52) U.S. Cl.
CPC ..... *F04C 29/12* (2013.01); *F04C 2240/10* (2013.01); *F04C 2240/30* (2013.01); *F04C 2240/803* (2013.01); *F04C 2240/808* (2013.01); *F05C 2201/903* (2013.01)

(58) Field of Classification Search
CPC ..... F04C 2240/803; F04C 2240/808; F04C 2250/30; F01C 1/0207–0292
See application file for complete search history.

(56) References Cited

U.S. PATENT DOCUMENTS

| | | | | |
|---|---|---|---|---|
| 2003/0143090 | A1* | 7/2003 | Iritani | F04C 23/008 417/410.5 |
| 2005/0201873 | A1 | 9/2005 | Ogawa et al. | |
| 2010/0028175 | A1 | 2/2010 | Ichise et al. | |

FOREIGN PATENT DOCUMENTS

| | | | | | |
|---|---|---|---|---|---|
| CN | 102686881 | A | | 9/2012 | |
| CN | 103122855 | A | * | 5/2013 | |
| CN | 203463290 | U | | 3/2014 | |
| CN | 205401113 | U | | 7/2016 | |
| CN | 106930941 | A | | 7/2017 | |
| CN | 106949049 | A | | 7/2017 | |
| CN | 106968948 | A | | 7/2017 | |
| CN | 106989017 | A | | 7/2017 | |
| CN | 106989018 | A | | 7/2017 | |
| CN | 107013460 | A | | 8/2017 | |
| CN | 107023482 | A | | 8/2017 | |
| CN | 107100845 | A | | 8/2017 | |
| CN | 107100846 | A | | 8/2017 | |
| CN | 206889251 | U | | 1/2018 | |
| CN | 206889252 | U | | 1/2018 | |
| CN | 207033726 | U | | 2/2018 | |
| EP | 0012615 | A1 | * | 6/1980 | F04C 18/0269 |
| EP | 2197097 | A1 | | 6/2010 | |
| JP | S61195736 | U | | 12/1986 | |
| JP | H0552288 | U | | 7/1993 | |
| JP | H1122660 | A | | 1/1999 | |
| JP | 2002295378 | A | | 10/2002 | |
| JP | 2003074480 | A | | 3/2003 | |
| JP | 2004251161 | A | | 9/2004 | |
| JP | 2005155368 | A | | 6/2005 | |
| JP | 2007120412 | A | | 5/2007 | |
| JP | 2007315270 | A | | 12/2007 | |
| JP | 2007321563 | A | | 12/2007 | |
| JP | 2011069311 | A | | 4/2011 | |
| JP | 2015175343 | A | | 10/2015 | |
| KR | 20110036958 | A | * | 4/2011 | F04B 39/121 |
| KR | 20150051538 | A | * | 5/2015 | |
| WO | 9317239 | A1 | | 9/1993 | |
| WO | 2010024021 | A1 | | 3/2010 | |

OTHER PUBLICATIONS

The International Search Report dated May 30, 2018 by the WIPO.
The CN1OA issued Feb. 20, 2019 by the CNIPA.
The 2nd Office Action dated May 11, 2021 for JP patent application No. 2020-509142.
The EESR issued Nov. 12, 2020 by the EPO.
The Notice of Allowance dated Jan. 5, 2022 for JP patent application No. 2020-509142.

* cited by examiner

SCROLL COMPRESSOR INCLUDING RETAINING WALL HOUSING ELECTRICAL MACHINERY MECHANISM

CROSS-REFERENCE TO RELATED APPLICATIONS

This application is a continuing application of International Application No. PCT/CN2018/078314, filed on Mar. 7, 2018, Which is based upon and claims priority to Chinese Patent Application 201710294487.2, filed on Apr. 28, 2017, the entire contents of which are incorporated herein by reference.

TECHNICAL FIELD

The present disclosure relates to the field of compressors, and more particularly, to a vertical compressor of vehicles.

BACKGROUND

The present compressors of vehicles have characters and disadvantage presented in the followings.

1) The structure of the current compressors is horizontal structure including a transmission gear of shafting and a pump, wherein both of the transmission gear of shafting and the pump are horizontally assembled. Compared with the vertical compressor, the disadvantage is that it is not easy to form a stable lubricating oil pool. Moreover, the internal oil recycling and lubrication are quite difficult and the compressor has large oil discharge. When solid impurities enters into the compressor, the impurities carried by refrigerants easily flow into the pump and cause damages of the pump part.

2) In the current processor, the housing of the compressor is made by applying machining on die-cast aluminum alloy housing blank (the machining portions including the end face of the casing, the inner hole of the casing and the motor, and the inner hole of the bearing, the bearing hole and the end face, etc.). Since the die-casting part is likely to have air holes, the die-casting housing may have a large machining area and a large number of machining parts, the air hole may be penetrated during the machining process and result in poor airtightness of the housing.

3) Since ordinary cast aluminum alloy parts do not have high material strength and compactness, compared with high strength aluminum alloys, e.g. forging or extrusion casting and the inlet opening and the exhaust opening of the compressor are formed on the casting part, the thread tooth for installing the suction plate and the exhaust plate are easy to be damaged.

4) The exterior of the current compressor is cylindrical like. There is tiny space surrounding the main body of the compressor when the compressor is installed in the vehicle. However, it is difficult to deploy other components in the tiny space. Therefore, the installation space around the compressor, installed in the vehicle, is not well utilized.

SUMMARY

In the present disclosure, a vertical compressor of vehicles is provided to improve reliability and utilization of occupied space of the compressor.

In the present disclosure, a compressor is provided. The compressor includes a housing including a first opening to form a receiving space and a retaining wall, wherein the receiving space is divided, by the retaining wall, a low-pressure chamber and a controller chamber. A compressing mechanism comprises a fixed scroll plate including a low-pressure side of scroll wraps and a high-pressure side, opposite to the scroll wraps. A orbiting scroll plate, located in the receiving space, includes a side, facing the scroll wraps of the fixed scroll plate, of scroll wraps and a compression chamber is formed by the scroll wraps of the fixed scroll plate and the scroll wraps of the orbiting scroll plate. An electrical machinery mechanism, located in the low-pressure chamber, includes a rotor and a stator, wherein the electrical machinery mechanism drives the compressing mechanism to rotates to compress refrigerant in the compression chamber.

BRIEF DESCRIPTION OF THE DRAWINGS

The accompanying drawings, which are incorporated in and constitute a part of this specification, illustrate embodiments consistent with the invention and, together with the description, serve to explain the principles and advantages of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

A compressor, a scroll compressor of vehicles, is disclosed to overcome the disadvantages of the prior art. Each of the following exemplary embodiments illustrates a compressor including a vertical structure, the shaft transmission mechanism is vertically disposed along the axis of the scroll pump body.

Figure 1:
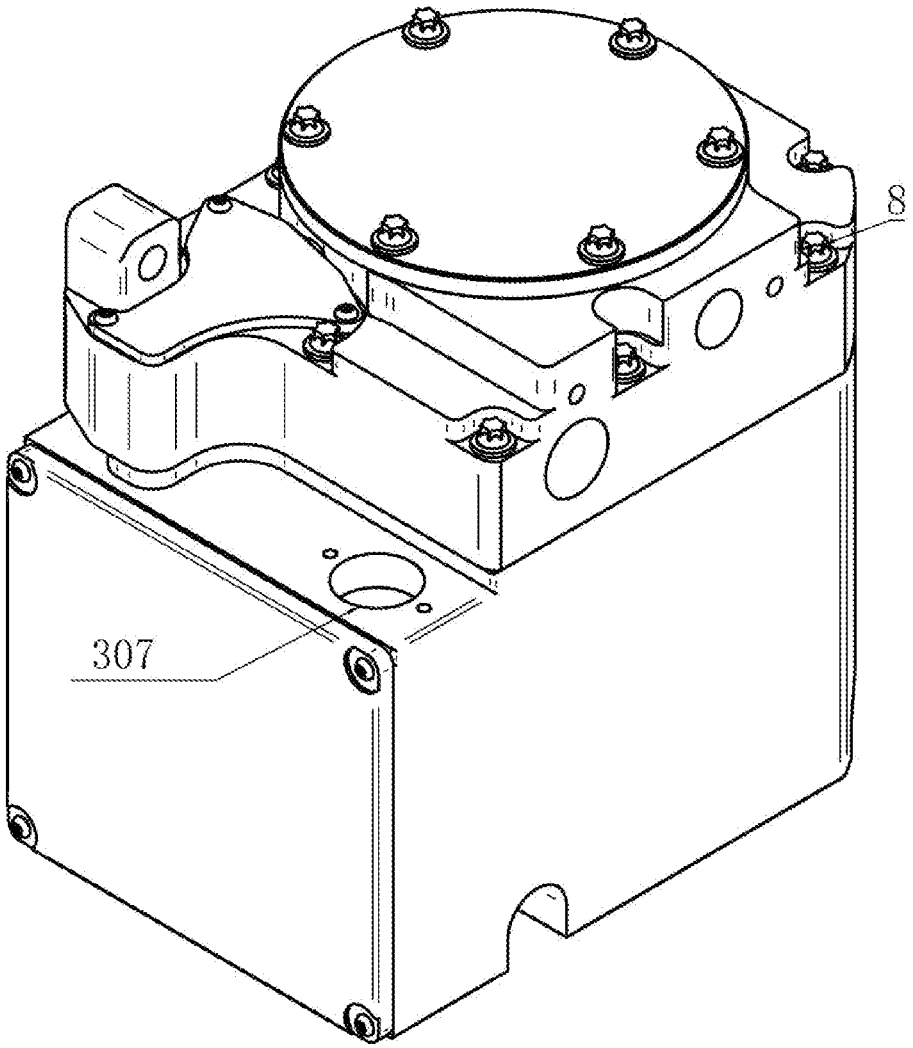
FIG. 1 is a three-dimensional view of a compressor of the present disclosure, according to an exemplary embodiment.
Figure 2:
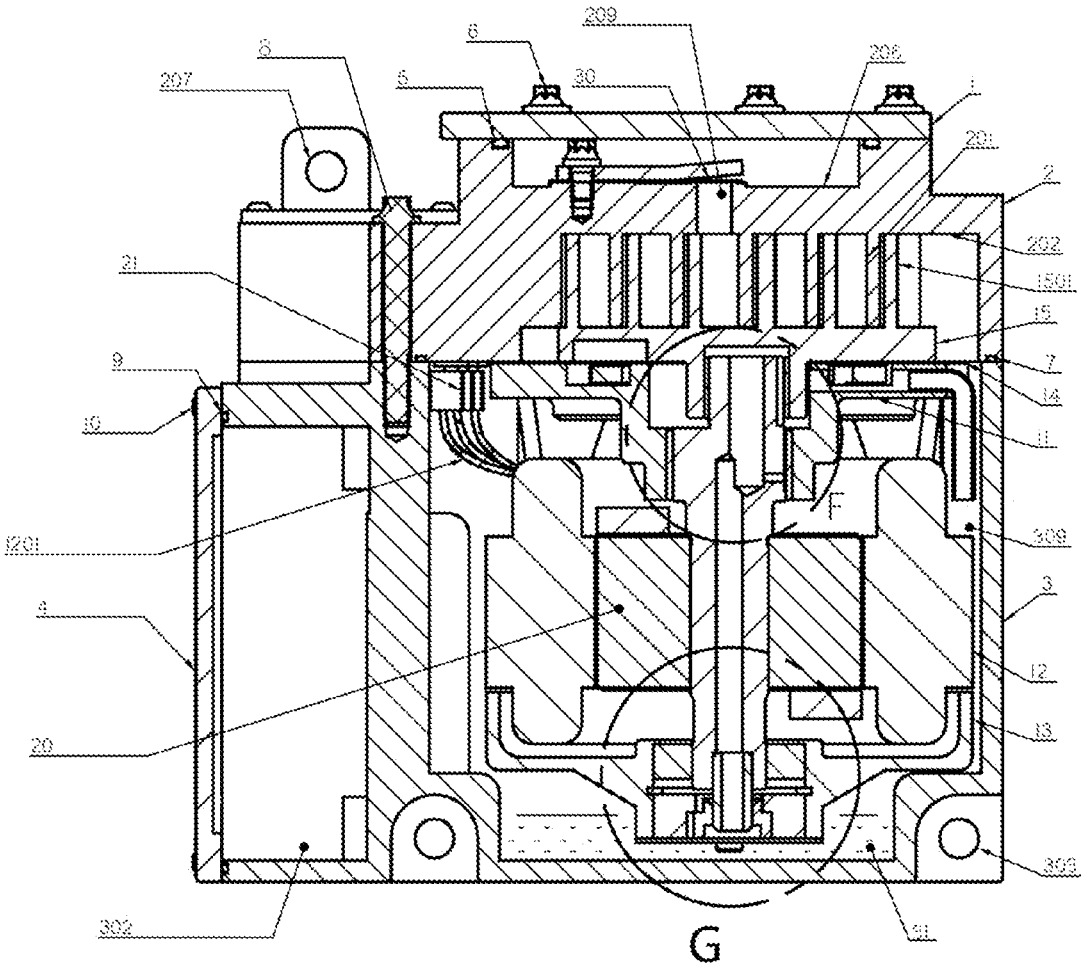
FIG. 2 is a cross-sectional view of a compressor of the present disclosure, according to an exemplary embodiment.
Figure 3:
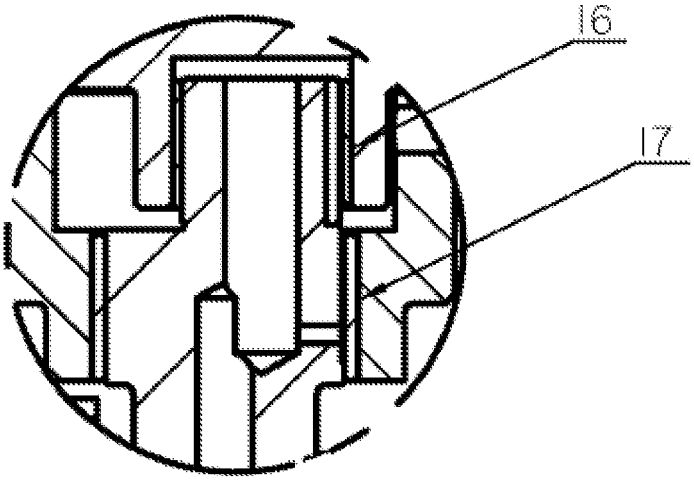
FIG. 3 is a partial view F of FIG. 2.
Figure 4:
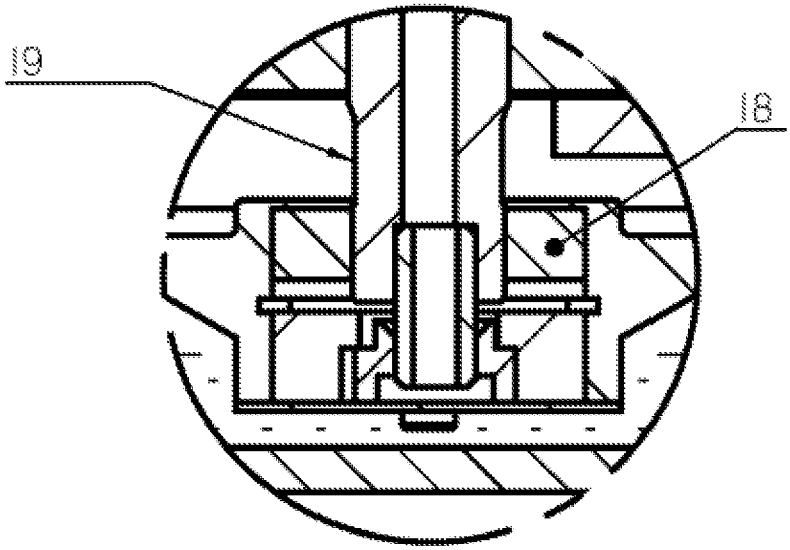
FIG. 4 is a partial view G of FIG. 2.
Figure 5:
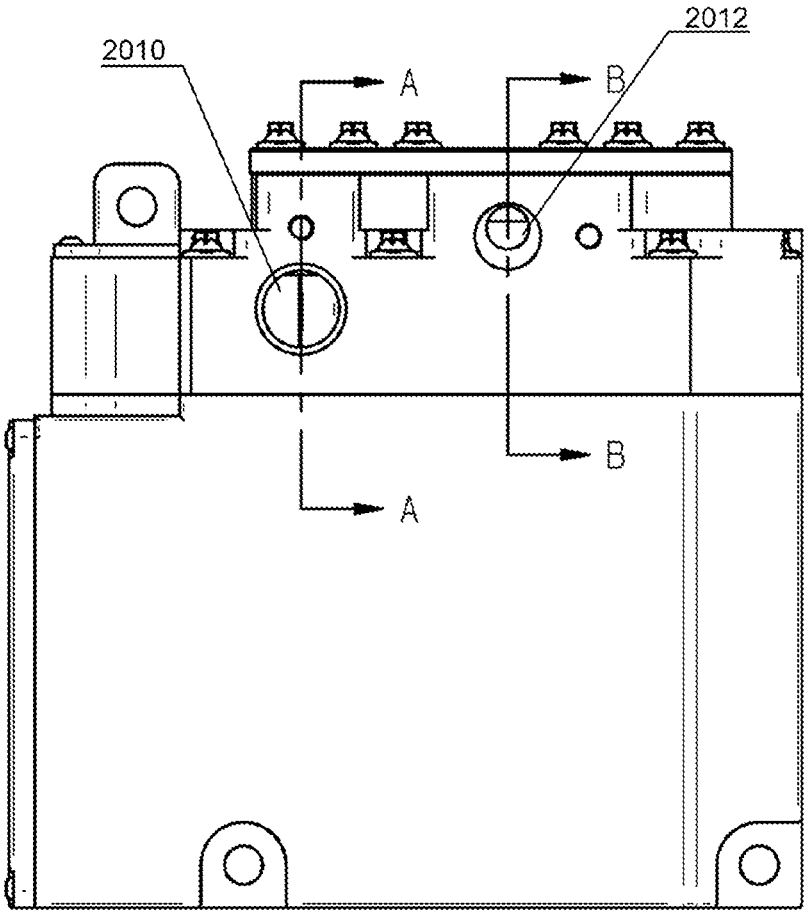
FIG. 5 is a schematic view of a compressor of the present disclosure, according to an exemplary embodiment.
Figure 6:
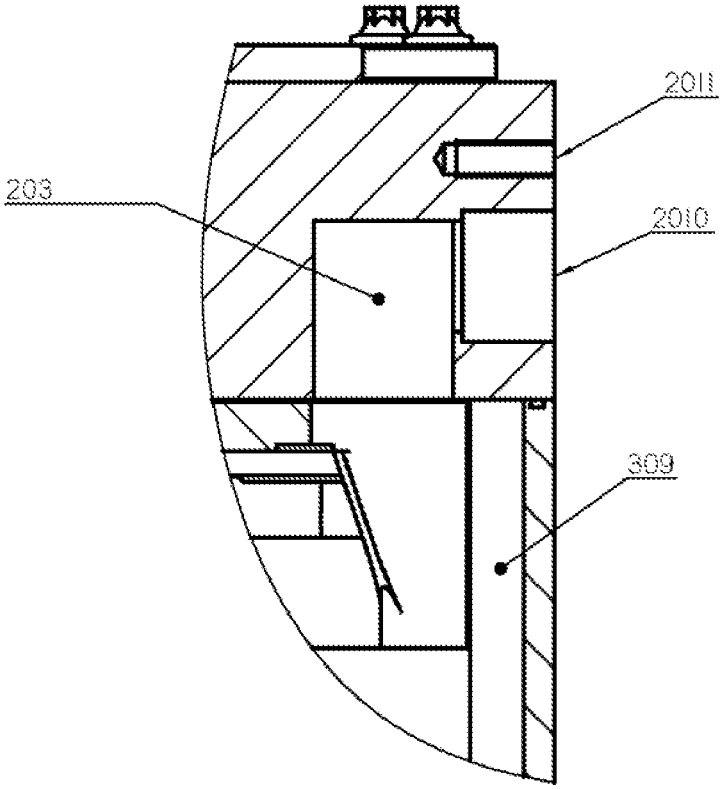
FIG. 6 is a cross-sectional view along line A-A of FIG. 5.
Figure 7:
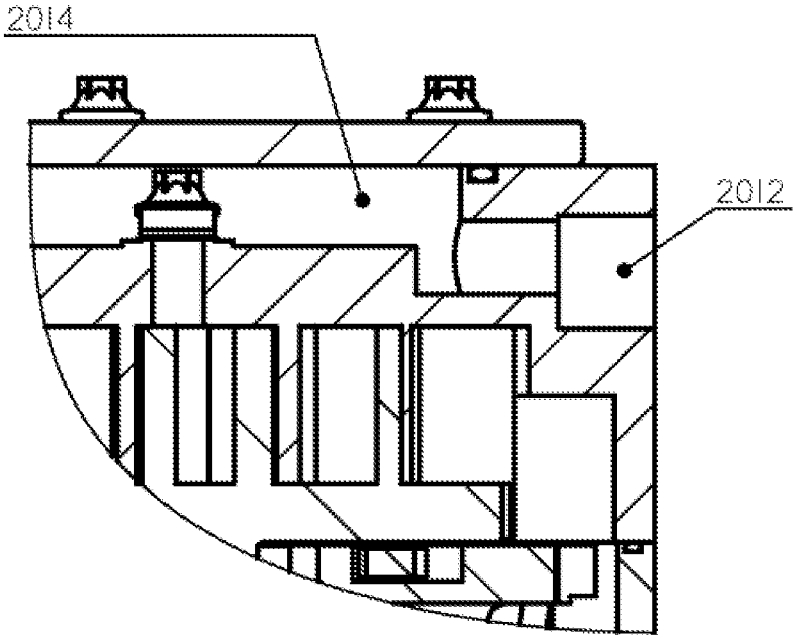
FIG. 7 is a cross-sectional view along line B-B of FIG. 5.
Figure 8:
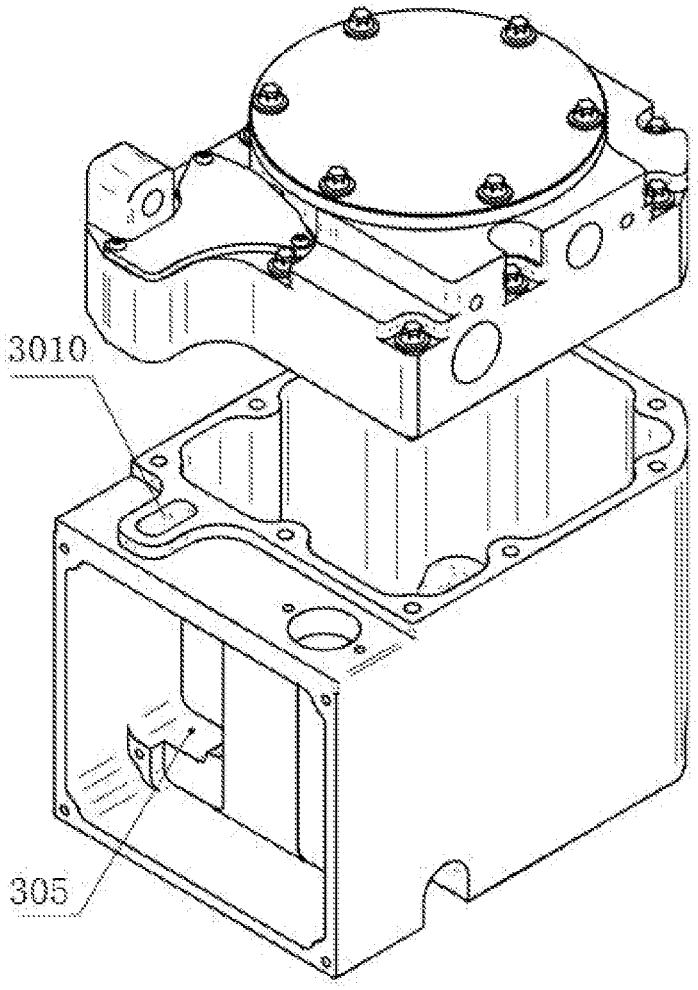
FIG. 8 is an explosion view of a compressor housing of the present disclosure, according to an exemplary embodiment.
Figure 9:
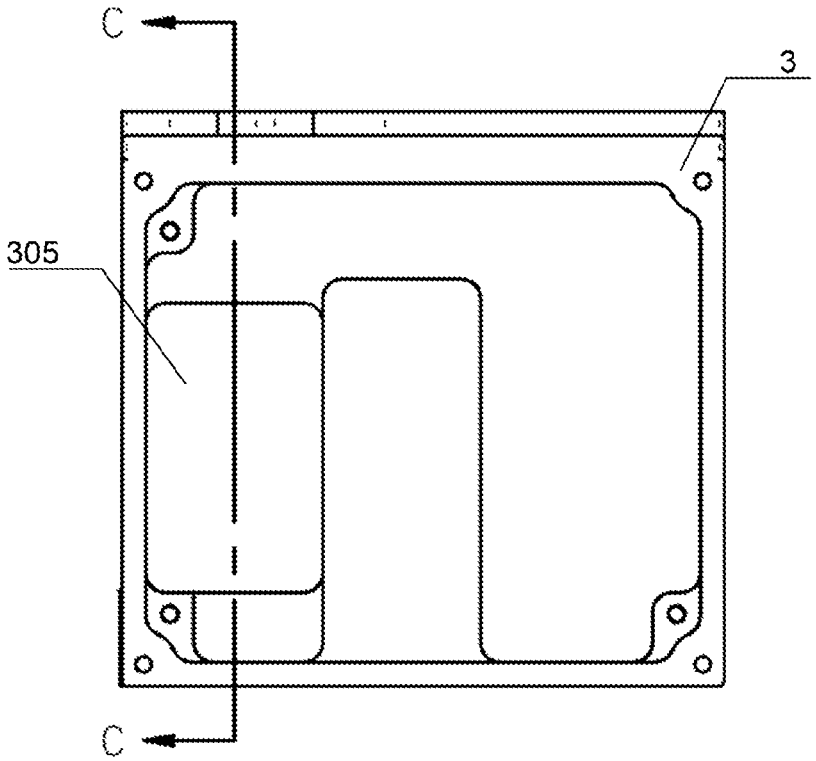
FIG. 9 is a cross-sectional view of a compressor housing of the present disclosure, according to an exemplary embodiment.
Figure 10:
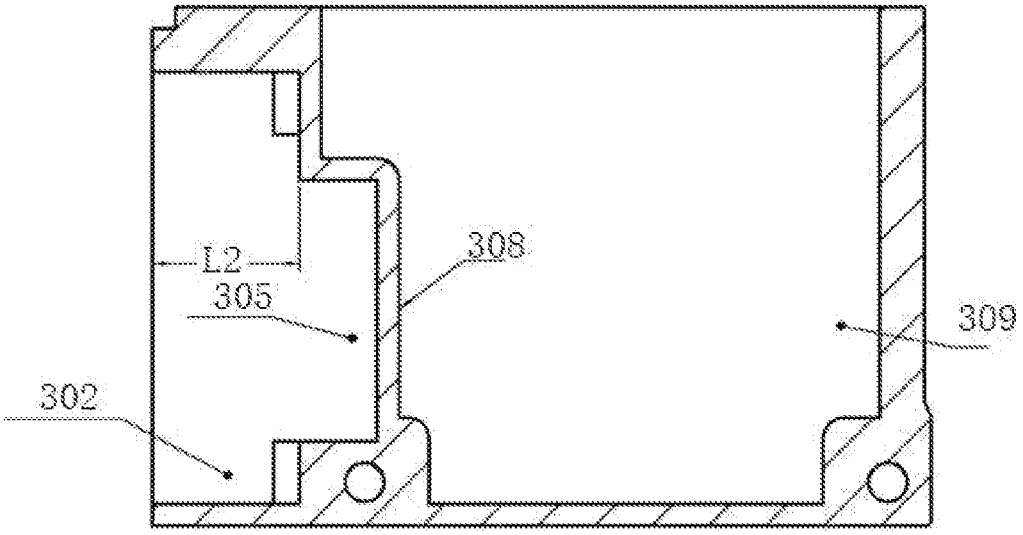
FIG. 10 is a cross-sectional view along line C-C of FIG. 9.
Figure 11:
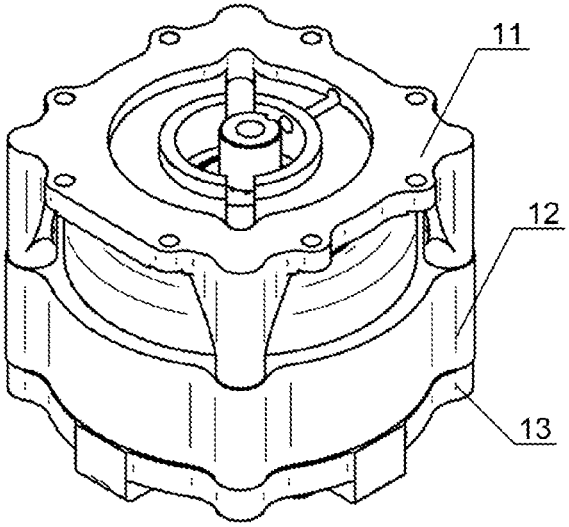
FIG. 11 is a three-dimensional view of an upper-holder, an electrical machinery mechanism and a lower holder, according to an exemplary embodiment.
Figure 12:
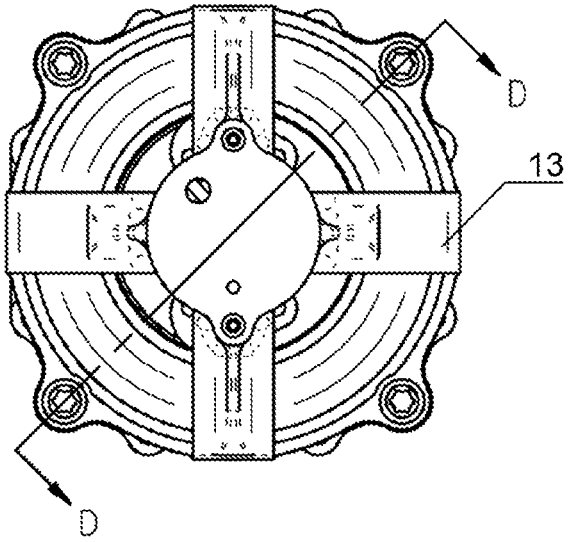
FIG. 12 is a bottom view of an upper holder, an electrical machinery mechanism and a lower holder, according to an exemplary embodiment.
Figure 13:
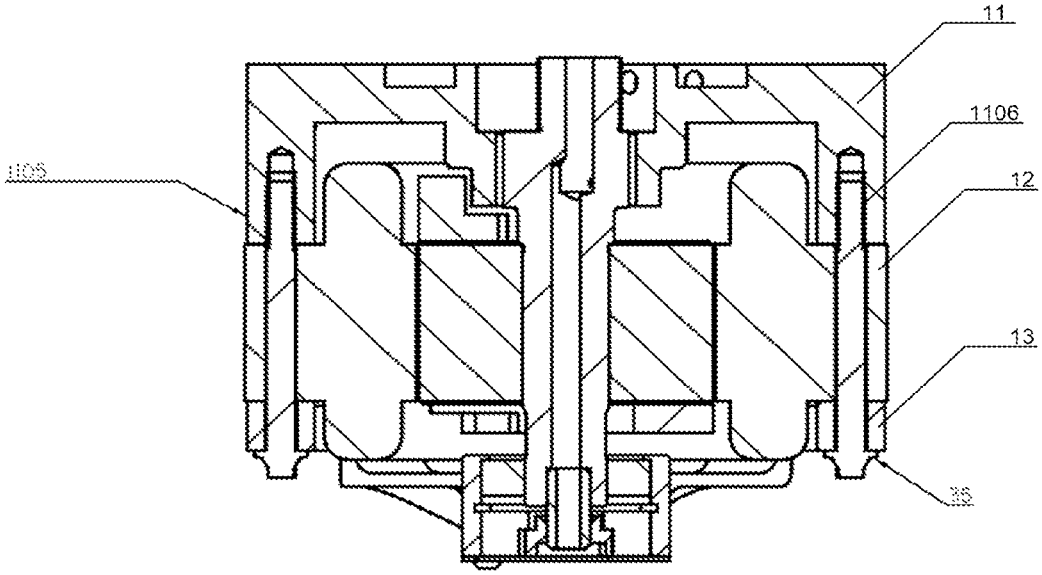
FIG. 13 is a cross-sectional view along line D-D of FIG. 12.
Figure 14:
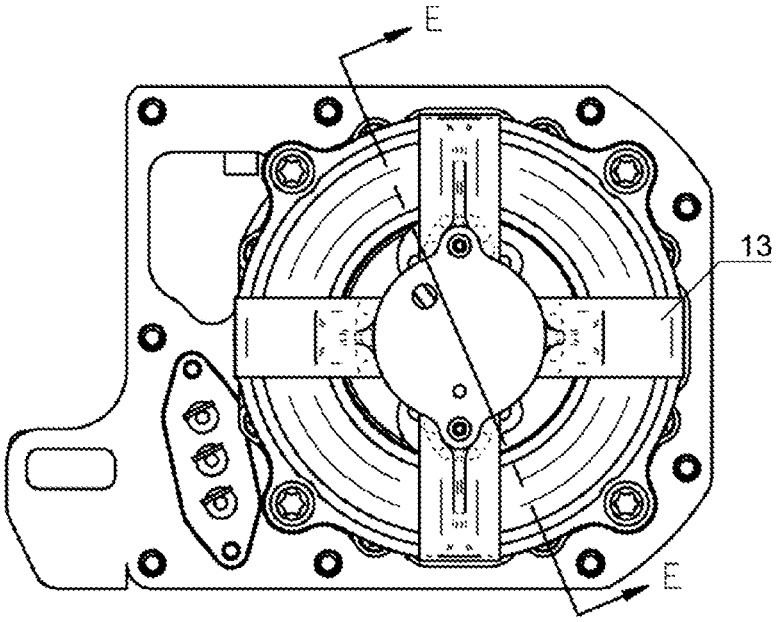
FIG. 14 is a bottom view of interior of the housing of a compressor of the present disclosure, according to an exemplary embodiment.
Figure 15:
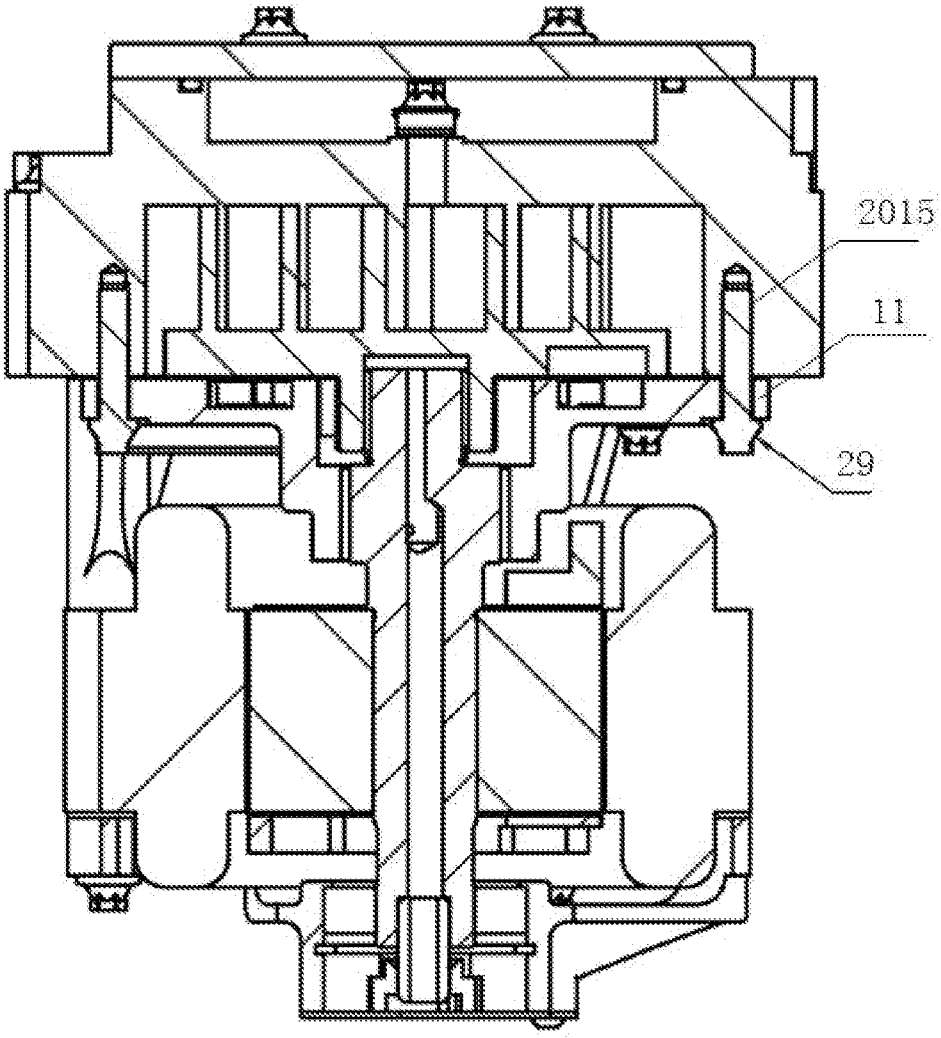
FIG. 15 is a cross-sectional view along line E-E of FIG. 14.
Figure 16:
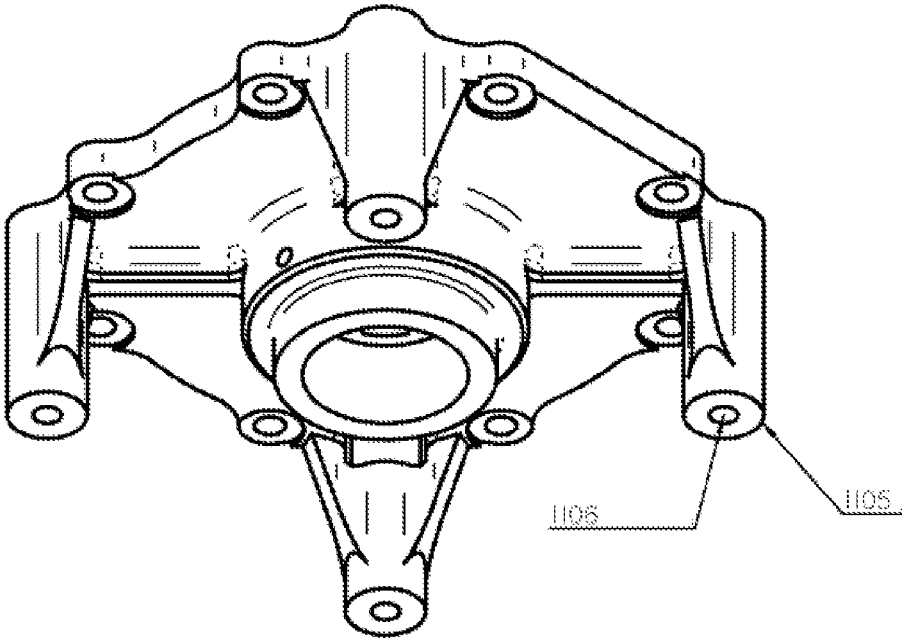
FIG. 16 is a three-dimensional view of an upper holder, according to an exemplary embodiment.

A specific embodiment of the present invention is presented first according to FIGS. 1 to 16. FIG. 1 is a three-dimensional view of a compressor of the invention, according to an exemplary embodiment. FIG. 2 is a cross-sectional view of a compressor of the disclosure, according to an exemplary embodiment. FIG. 3 is a partial view F of FIG. 2. FIG. 4 is a partial view G of FIG. 2. FIG. 5 is a schematic view of a compressor of the disclosure, according to an exemplary embodiment. FIG. 6 is a cross-sectional view along line A-A of FIG. 5. FIG. 7 is a cross-sectional view along line B-B of FIG. 5. FIG. 8 is an explosion view of a compressor housing of the disclosure, according to an exemplary embodiment. FIG. 9 is a schematic view of a compressor housing of the disclosure, according to an exemplary embodiment. FIG. 10 is a cross-sectional view along line C-C of FIG. 9. FIG. 11 is a three-dimensional view of an upper-holder, an electrical machinery mechanism and a lower holder, according to an exemplary embodiment. FIG. 12 is a bottom view of an upper holder, an electrical machinery mechanism and a lower holder, according to an exemplary embodiment. FIG. 13 is a cross-sectional view line D-D of FIG. 12. FIG. 14 is a bottom view from inside the housing of a compressor of the disclosure, according to an exemplary embodiment. FIG. 15 is a cross-sectional view along line E-E of FIG. 14. FIG. 16 is a three-dimensional view of an upper holder, according to an exemplary embodiment.

In this embodiment, the vertical compressor includes a housing 3, a compressing mechanism including a fixed scroll plate 2, an orbiting scroll plate 15, and an electrical machinery mechanism. In some embodiments, the vertical compressor further includes an upper cover 1.

The housing 3 includes a first opening. In some embodiments, the housing 3 is a casting. The housing 3 includes a retaining wall 308 for dividing a receiving space to a low-pressure chamber 309 and a controller chamber 302. Moreover, the vertical compressor includes a controller-chamber cover 4 for sealing a second opening, and electric controlling components. In some embodiments, the controller-chamber 4 and the housing 3 are fastened and sealed via a sealing ring 9 (or a sealing pad, or sealing glue) and bolts 10. The electric controlling components are disposed, between the controller-chamber cover 4 and the retaining wall, in the controller chamber 302. In some embodiments, the retaining wall 308 includes a reentrant 305 facing an opening of the controller chamber. The electric controlling components include a first electric controlling component and a second electric controlling component. The first electric controlling component is disposed in the reentrant 305. The first electric controlling component includes, but not limited thereto, at least one of capacitors, inductors and relays. The second electric controlling component is patched with a portion of the retaining wall 308, wherein the portion of retaining wall 308 is outside of the reentrant 305. The second controlling component includes power components. Specifically, the location of the reentrant 305 is at a side of the low-pressure chamber 309 without interfering with the internal components of the low-pressure chamber 309. At a side of the controller chamber 302, the power component is patched with a portion of the retaining wall 308, wherein the portion of the retaining wall 308 is disposed outside of the reentrant 305. In the low-pressure chamber, the refrigerant, coming through the suction chamber 203, flows by the retaining wall 308, and the heat, generated by the power components, is absorbed by the refrigerant.

In this way, the surplus space in the low-pressure chamber 309 is divided, by the retaining wall 308, for receiving electrical controlling components, and the width L2 of the controller chamber 302 is then reduced, and the size of the vertical scroll compressor is minimized. In some embodiments, the remaining second electrical controlling components which are not disposed in the reentrant 305 may be not be patched with the retaining wall 308.

The fixed scroll plate 2 includes a low-pressure side 202 of scroll wraps 201 and a high-pressure side 206, opposite to the scroll wraps 201. The low pressure side 202 of the fixed scroll plate 2 is facing towards the first opening of the housing 3 to form a receiving space. In some embodiments, the shape of the receiving space, formed between the housing 3 and the low pressure side of the fixed scroll plate 2, is similar to a cuboid. It should be noticed that, in some embodiments, the receiving space is also a cylindrical or a cubic. The housing 3 and the fixed scroll plate 2, in some embodiments, are fastened and sealed by a sealing ring 7 (or a sealing pad, or sealing glue) and bolts 8. The fixed scroll plate is made of aluminum alloy with characters of abrasion-resistant and high-strength, e.g. forged aluminum alloy or extrusion casted aluminum alloy, wherein the material strength and compactness of a component made of aluminum alloy with a high-strength character are superior to the material strength and compactness of a common casting one. In some embodiments, at least one of the installation feet 207, 303 is disposed on the fixed scroll plate 2 and the housing 3 to install the compressor in an automobile.

A high-pressure chamber 2014 is formed between the upper cover 1 and the high-pressure side 206 of the fixed scroll plate 2. An exhaust valve 30 and an exhaust baffle are installed in the high-pressure chamber 2014. In some embodiments, the upper cover 1 and the fixed scroll plate 2 are fastened and sealed by a sealing ring 5 (or a sealing pad, or sealing glue) and bolts 6. A suction chamber 203 is formed on the low-pressure side 202 of the fixed scroll plate 2. The fixed scroll plate 2 includes an exhaust port 2012 connecting the high-pressure chamber 2014 and a suction port 2010 connecting the suction chamber 203. The fixed scroll plate 2 further includes a threaded hole 2011. The suction chamber 203 is connected to the suction port 2010. In another word, the fixed scroll plate 2, made of high-strength aluminum alloy, acts as a portion of the housing of the compressor, and the fixed scroll plate 2 includes both of the suction port 2010 and the exhaust port 2012. Since strength and compactness of a component made of high-strength aluminum alloy, e.g. forged aluminum alloy or extrusion casted aluminum alloy, is superior to strength and compactness of a common cast component, the airtightness and thread strengths of the suction port 2010 and the exhaust port 2012 are improved. In the meantime, since the housing 3, produced by casting process, includes less portions and areas being produced by machining process, the airtightness of the housing 3 is improved and the airtightness of the compressor is improved as well.

The orbiting scroll plate 15 is located in the receiving space, and a side, including scroll wraps 1501, of the orbiting scroll plate 15 is faced towards the low-pressure side of the fixed scroll plate 2. A compression chamber is formed between the scroll wraps 201 of the fixed scroll plate 2 and the scroll wraps 1501 of the orbiting scroll plate 15.

The electrical machinery mechanism, located in the low-pressure chamber 309 in the receiving space, includes a rotor 20 and a stator 12, and drives the orbiting scroll plate 15 to rotate relative to the fixed scroll plate 2, compressing refrigerant in the compression chamber.

In some embodiments, the pathway of the refrigerant of the compressor is the following. The refrigerant enters the suction chamber 203, connected to the low-pressure chamber 309, through the suction port 2010. The refrigerant flows into the low-pressure side 202 of the fixed scroll plate 2 via the low-pressure chamber 309, and then the refrigerant flows into the compression chamber, formed between the scroll wraps 201 of the fixed scroll plate and the scroll wraps 1501 of the orbiting scroll plate, to be compressed. The compressed refrigerant flows into the high-pressure chamber 2014 via the outlet 209, and then the compressed refrigerant flows into the exhaust port 2012 connected to the high-pressure chamber 2014.

Furthermore, the refrigerant flows into the vertical compressor via the suction port 2010 of the fixed scroll plate 2, and then flows away the fixed scroll plate and towards the bottom wall of the housing 3. The refrigerant flows by the retaining wall 308 of the housing 3 and cools down electrical controlling components inside the controller chamber 302. The refrigerant also flows by the electrical machinery mechanism to cool down the electrical machinery mechanism. The refrigerant then flows into the compression chamber formed between the static and fixed scroll plate 2 and the orbiting scroll plate 15.

As mentioned above, in some embodiments of the present disclosure, a compressor includes a vertical structure. Since the shape of the receiving space, located inside the housing, is similar to a cuboid, the length of the overall compressor is shorter than the length of a horizontal compressor but the height of the compressors is the same. Therefore, the compressor occupies less horizontal space for installation, and a stable oil pool 31 is formed at the bottom of the low-pressure chamber 309 of the compressor, such that the target of better lubrication performance is achieved. Thus, the reliability of the compressor is improved and the oil consumption is reduced. Moreover, when solid impurity enters the compressor via the suction port 2010 and the suction chamber 203, the solid impurity is deposited on the bottom of the low-pressure chamber 309, thus, there is minor chance for solid impurity entering into the compressing chamber formed between the fixed scroll plate 2 and the orbiting scroll plate 15. Thus, the risk of damages, caused by the solid impurity, of the pump body is then reduced.

In some embodiments, the compressor further includes an upper holder 11 and a lower holder 13. Each of the upper holder 11 and the lower holder 13 includes a through hole which allows the shaft-bearing mechanisms to go through.

The upper holder 11 is connected and fixed to the low-pressure side 202 of the fixed scroll plate 2, In some embodiments, bolts 29 go through the through hole of the upper holder 11 and a threaded hole 2015 of the fixed scroll plate 2, which allows the low-pressure side 202 of the fixed scroll plate 2 connect and fix the upper holder 11.

The lower holder 13 is connected and fixed to the upper holder 11 via the stator 12. More specifically, in this embodiment, the upper holder 11 includes a first side connected and fixed to the fixed scroll plate 2, and a second side opposite to the first side. A plurality of upper-holder bosses 1105 is disposed on the second side of the upper holder 11. Each of the upper-holder bosses 1105 includes a threaded hole 1106. The stator 12 includes a plurality of first bolt-through holes corresponding to the threaded holes 1106. The lower holder 13 includes a plurality of second bolt-through holes corresponding to the threaded holes 1106. Bolts 35 go through the second bolt-through holes, the first bolt-through holes and the threaded holes 1106 for fixing the upper holder 11, the stator 12 and the lower holder 13. The upper holder 11, the stator 12 and the lower holder 13 are hung on the low-pressure side of the fixed scroll plate 2 and do not contact the housing 3.

The upper holder 11, the stator 12 and the lower holder 13 are fixed and then hung on the fixed scroll plate 2, and the upper holder 11, the stator 12 and the lower holder 13 do not contact the housing 3. Thus, vibration and noise of the electrical motor and transmission mechanisms are avoided to be conducted via the housing 3 and vibration and noise of the overall compressor are reduced. Since the interference fit of the stator 12 and the housing 3 is eliminated, precision requirements for the housing 3 and the stator 12 are lowered down which reduces production costs. Moreover, the connection structure provides visual examinations when the parts inside the compressor are assembled. Thus, faulty operation in assembling is then avoided. Therefore, the ways of producing and assembling the parts of the compressor are optimized by the connection structure and the production cost is reduced as well.

The orbiting scroll plate 15, in some embodiments, includes a shaft-hearing hole on a side opposite to the fixed scroll plate 2. A dynamic-vortex-plate bearing 16 is disposed in the shaft-bearing hole. An abrasion resistant pad 14 is located between the upper holder 11 and the orbiting scroll plate 15, Optionally, the compressor includes an upper bearing 17 and a lower bearing 18, wherein the upper bearing 17 and the lower bearing 18 are each sleeved on one end of an eccentric crankshaft 19. The eccentric crankshaft 19 provides power for the orbiting scroll plate 15 to rotate.

Figure 17:
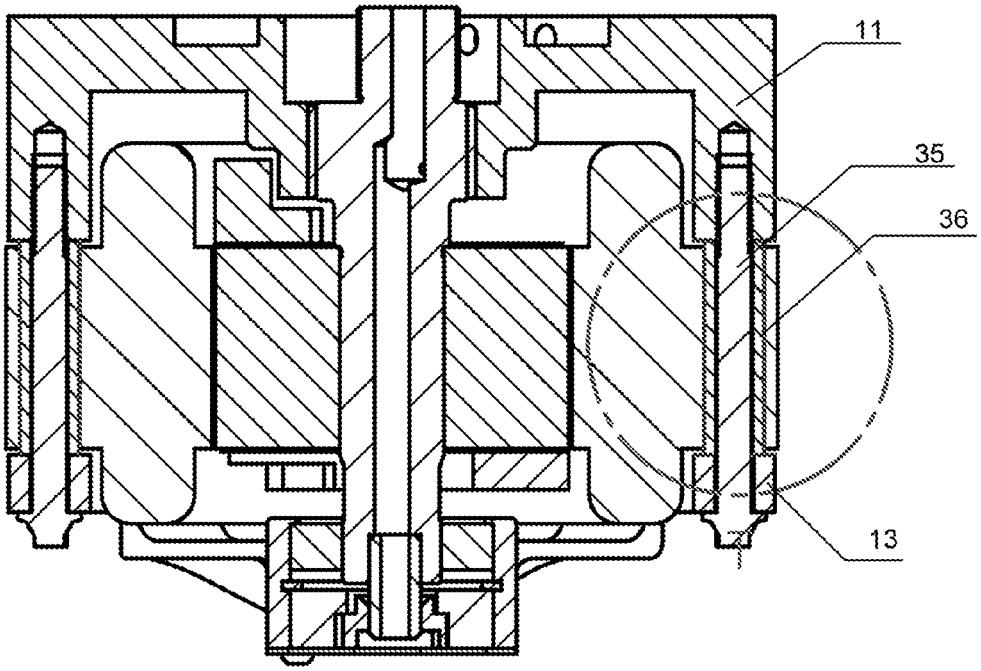
FIG. 17 is a cross-sectional view of the assembly of an upper holder, an electrical machinery mechanism and a lower holder, according to an exemplary embodiment.
Figure 18:
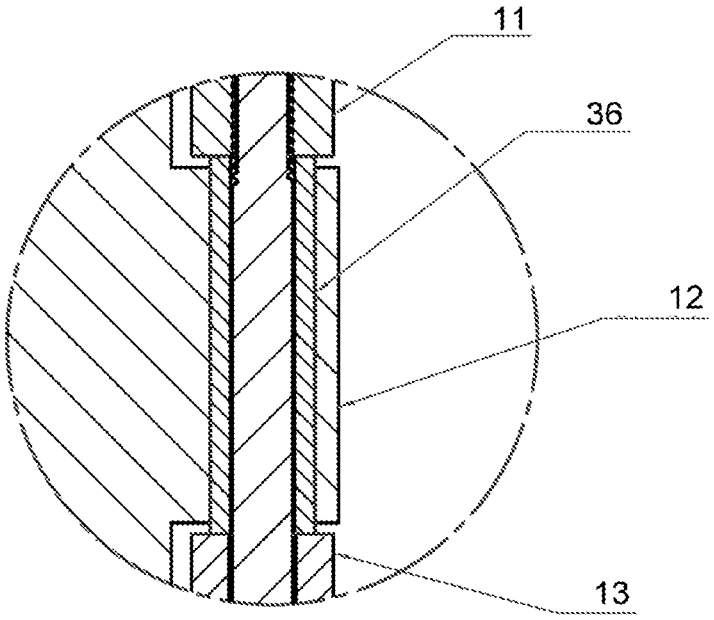
FIG. 18 is a partial view of FIG. 17.

Furthermore, referring to FIGS. 17 and 18, FIG. 17 is a cross-sectional view of the assembly of an upper holder, an electrical machinery mechanism and a lower holder according to another exemplary embodiment, and FIG. 18 is a partial view T of the assembly in FIG. 17. The compressor, in some embodiments, further includes guide pillars 36. Each of the bolts 35 goes through a guide pillar 36, which allows the guiding pillar 36 located between an inner wall of the first bolt-through holes of the stator 12 and the bolt 35. Interference fit is caused between the guide pillars 36 and the first bolt-through hole, wherein the guide pillars 36 includes an end abutting the upper holder 11 and the other end abutting the lower holder 13. In this way, axiality errors between shaft-bearing holes in the upper holder and the lower holder, induced by parallelism errors between end planes of the stator 12, or by flatness errors of the end planes of the rotor 20, are then eliminated. Thus, the assembling precision of the upper and lower bearings is improved, which increases the efficiency of the compressor. The axial length of the guide pillars 36, in some embodiments, is greater than the axial length of the first bolt-through holes. In some embodiments, the guide pillars 36 neatly abut the upper holder and the lower holder, and a distance is created between the stator 12 and the upper and lower holders.

Figure 19:
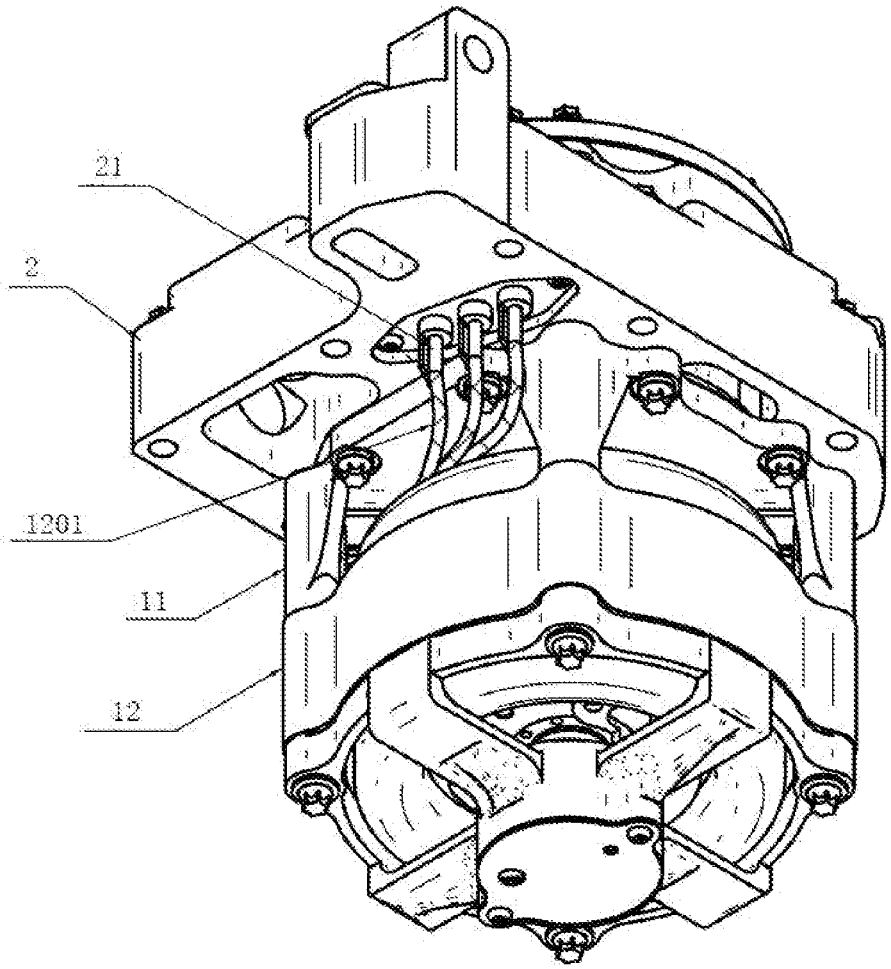
FIG. 19 is a three-dimensional view of components, located in compressor housing, according to another exemplary embodiment.
Figure 20:
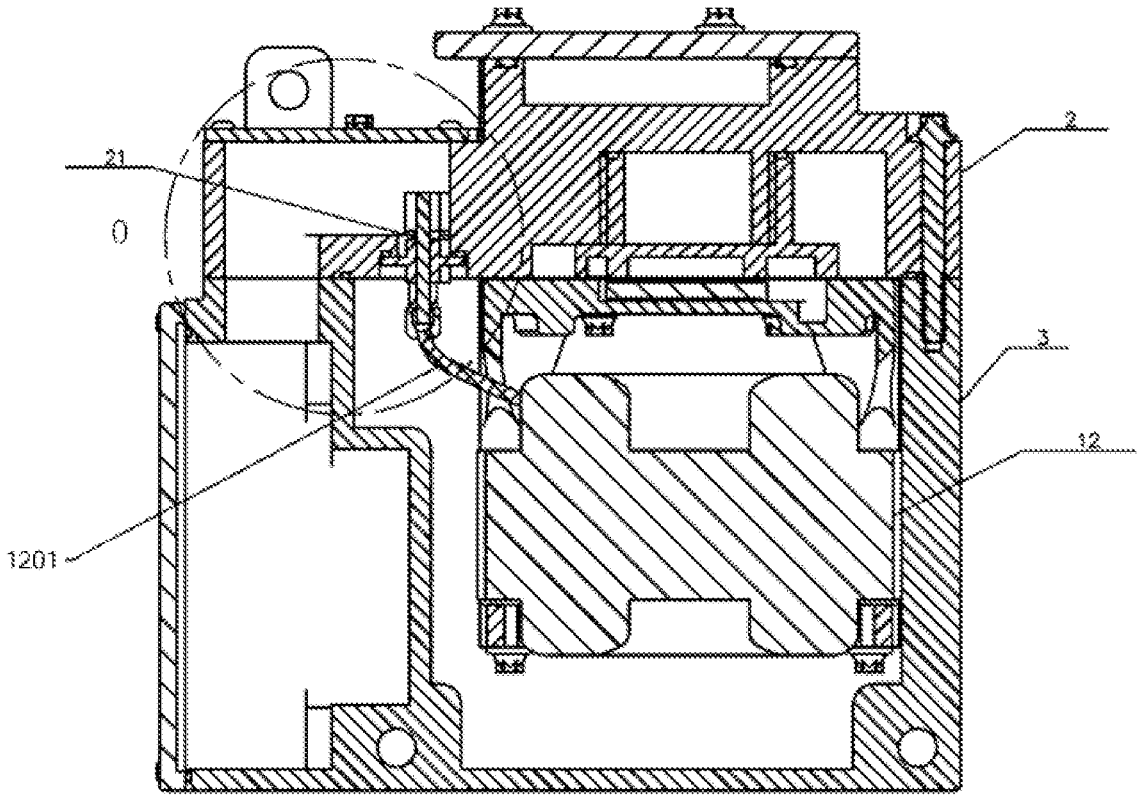
FIG. 20 is a cross-sectional view of a compressor, according to another exemplary embodiment.
Figure 21:
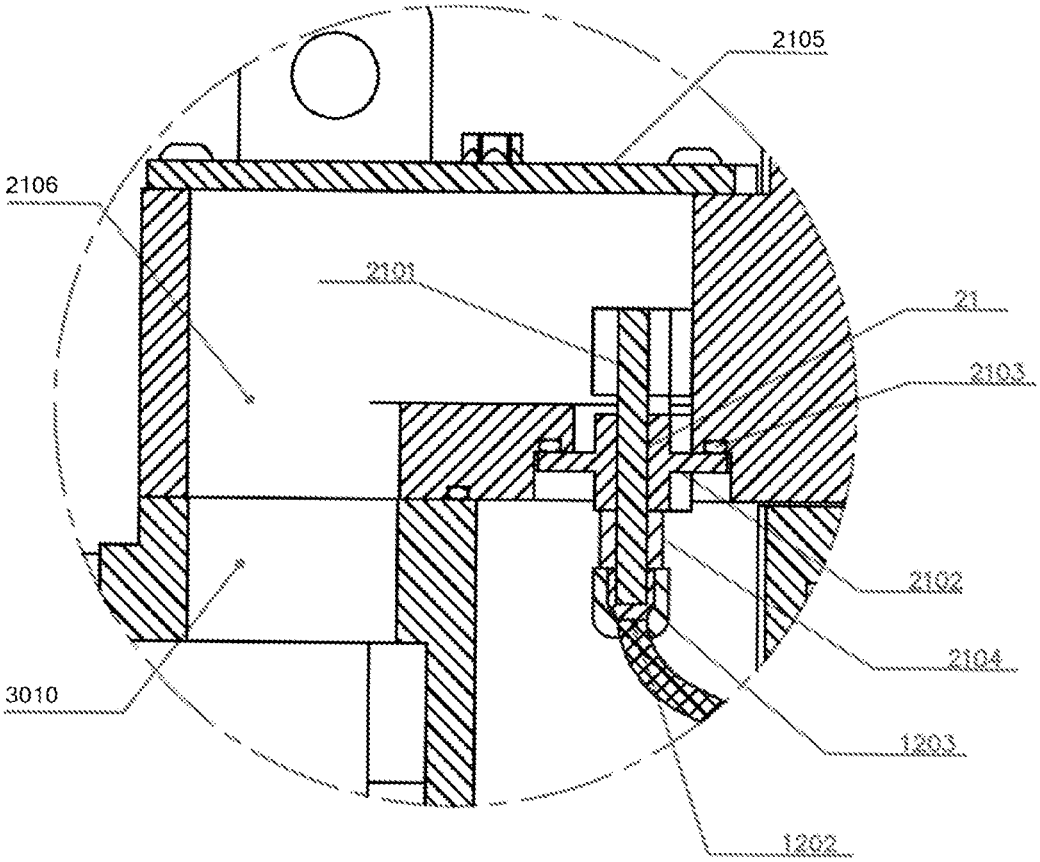
FIG. 21 is a partial view O of FIG. 20.
Figure 22:
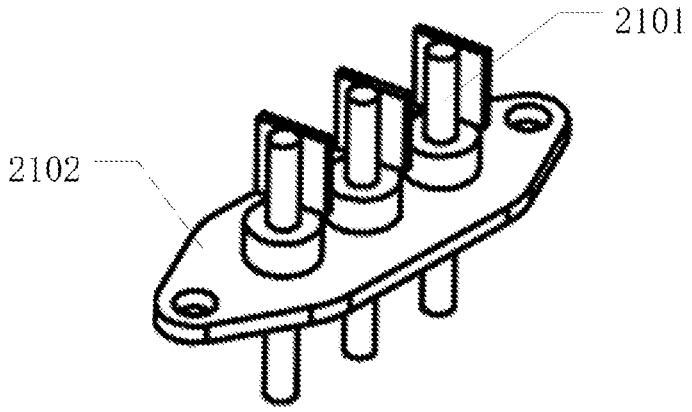
FIG. 22 is a three-dimensional view of a binding post, according to another exemplary embodiment.

Referring to FIGS. 19 to 22, FIGS. 19 to 22 discloses a compressor of another embodiment of the present disclosure. FIG. 19 is a three-dimensional view of components inside a compressor housing, according to another exemplary embodiment. FIG. 20 is a cross-sectional view of a compressor according to another exemplary embodiment. FIG. 21 is a partial view O of FIG. 20. FIG. 22 is a three-dimensional view of a binding post, according to another exemplary embodiment.

In this embodiment, the compressor is similar to the compressor in the previous embodiments. The compressor, in this embodiment, includes a housing 3, a compression mechanism and an electrical machinery mechanism. The housing 3 includes a first opening. The compression mechanism includes a fixed scroll plate 2 and an orbiting scroll plate 15. A receiving space is formed between a low-pressure side 202 of the fixed scroll plate 2 and the first opening of the housing 3, since the low-pressure side 202 of the fixed scroll plate 2 is faced to the first opening of the housing 3. The electrical machinery mechanism includes a rotor and a stator 12, located inside the receiving space, wherein the stator 12 is connected and fixed to the fixed scroll plate 2 via an upper holder 11.

In this embodiment, the stator 12 is coupled to a binding post 21 by lead-out wires, and then coupled to electric controlling components in a controller chamber 302 via a static-vortex-plate wiring through hole 2106 and a housing wiring through hole 3010. The binding post 21, disposed between the inner wall of the housing 3 and the outer wall of the stator 12, is located away form an oil pool 31. Thus, the binding post 21 is located near the top of the receiving space formed between the housing 3 and the fixed scroll plate 2. In some embodiments, each binding post includes a pin 2101 and an end plate 2102. The end plate 2102 includes a through hole which allows the pin 2101 to go through. Each of lead-out wires 1201 includes a terminal 1202 electrically coupled to a pin 2101 and an insulation cover 1203 covering external of the terminal 1202. Pins 2101, located between the insulation cover 1203 and the end plate 2102, are surrounded by insulation sleeves 2104. The internal diameter of each insulation sleeve 2104 is smaller than the diameter of each pin 2101. The binding post 21 is optionally disposed on the fixed scroll plate 2. In some embodiments, the fixed scroll plate 2 includes through holes which allows the pins 2101 of the binding post 21 to go through and a groove, facing an opening of the motor mechanism, surrounding the through hole. The through hole allows the pins 2101 of the binding post 21 of the fixed scroll plate 2 to go through. The end plate 2102, away from a surface of the electrical machinery mechanism, is contacted with a bottom wall of the groove. A wiring cover plate 2105 covers the end plane of the groove on the back surface of the fixed scroll plate 2, in order to protect the binding post 21 and wires connected to controllers.

In this embodiment, since the stator 12 is connected and fixed to the fixed scroll plate 2 and the binding post 21 is connected and fixed to the fixed scroll plate 2 as well, the positional relationship between the stator 12 and the binding post 21 is fixed. The fixed scroll plate 2 and the housing 3 are yet to be assembled, which provides sufficient operating room for assembling the lead-out wires 1201 and the binding post 21. Lead-out wires 1201 with suitable length, e.g. the length of the lead-out wire being exactly enough to bind the terminals 1202 to the pins 2101 of the binding post 21, provides a short redundant length of lead-out wires 1201. Each of the pins 2101 is sleeved with insulation sleeves 2104 before the terminals 1202 are bound to the binding post 21. The internal diameter of each insulation sleeve 2104 is less than the diameter of each pin 2101 such that the inner hole of the insulation sleeve 2104 is tightly fit the external surface of the pin 2101. Terminals 1201 are then installed on pins 2101, and the insulation covers 1203 are tightly pressed which causes elastic deformation of the insulation sleeves 2104. The insulation covers 1203 are tightly fit the insulation sleeves 2104, and the insulation sleeves 2104 are tightly fit the end plate 2102. The assembly of the lead-out wires 1201 and the binding post 21 is accomplished. Then, the fixed scroll plate 2 and the housing 3 are connected and fixed with bolts, to form a closed chamber.

The fixed scroll plate 2 is a portion of the housing of the compressor, and the binding post 21 is installed on the inner side of the fixed scroll plate 2. The stator 12 is indirectly installed on the fixed scroll plate 2 via the upper holder 11. This installing method ensures that the positional installation relationship of the lead-out wires 1201 and the binding post 21 are determined before the closed chamber is formed by the fixed scroll plate 2 and the housing 3. The positional installation relationship of the lead-out wires 1201 and the binding post 21 is unchangeable after the closed chamber is formed by the fixed scroll plate 2 and the housing 3. Furthermore, the length of the lead-out wires 1201 is able to be precisely calculated according to the install positions of the lead-out wires 1201 and the binding post 21 before the closed chamber is formed by the fixed scroll plate 2 and the housing 3. Thus, there is no redundant length of the lead-out wires 1201 after the lead-out wires 1201 and the binding hosts 21 being assembled. The lead-out wires 1201 is then properly fixed and the sways, caused by the vibration of the compressor, of the lead-out wires are eliminated. The lead-out wires 1201 have no possibility of touching nearby components or the housing of the compressor, which significantly improves the insulation and reliability of the compressor. Therefore, during the process of designing the housing 3 and parts of the lead-out wires 1201, only required electrical safe gap is reserved, which is good for minimizing compressors.

The installation position of binding post 21 and the lead-out wires 1201 is away from the oil pool, which is located at the top interior portion of the compressor. When liquid refrigerant, including lubricate oil or minor water and impurity, is existed in the compressor, the liquid refrigerant starts to accumulate at the interior bottom of the compressor. Therefore, the joint of the binding post 21 and the lead-out wires 1201 has fewer possibilities to be soaked in the liquid refrigerant since the installation position of binding post 21 and the lead-out wires 1201 is located at the top interior portion of the compressor. The insulation of the compressor is then improved.

Moreover, the assembling process of the lead-out wires 1201 and the binding post 21 is performed in an open environment which is outside the housing of the compressor. Therefore, there is sufficient operating space and the assembling process is completely viewable. The convenience of assembling and inspection processes are improved which will reduce the possibilities of error operation and improve production efficiency.

Furthermore, since the binding post 21 is installed on the low-pressure side of the fixed scroll plate 2 and the internal pressure in the compressor is greater than external pressure, the pressure difference of the internal pressure and the external pressure is applied on the end plate 2102 and forces the end plate 2102 to tightly abut the internal groove wall of the fixed scroll plate 2. Sealing parts 2103 of the binding post 21 provide ideal sealing between the binding post 21 and the low-pressure side of the fixed scroll plate 21 without applying too much pressure on the end plate 2102. Therefore, compared with the installation of installing the binding post 21 on the external side of the compressor, when the binding post 21 is installed on the low-pressure side of the fixed scroll plate 2, force condition of the binding post 21 and the sealing parts 2103 is better. The strength requirements of the binding post 21 and the sealing parts 2103 are not so strict, which helps weight reduction and cost reduction for related components.

Additionally, insulation protective device is added to the joint of the lead-out wires 1201 and the binding post 21. In some embodiments, insulation covers 1203 are disposed outside terminals 1202 of lead-out wires 1202. In some embodiments, insulation sleeves 2104 are disposed outside the pins 2101 and are between the insulation covers 1203 and the end plate 2102. The insulation protective devices are used to further reduce the possibility of the electrically conductive parts of the lead-out wires 1201 and the binding post 21 getting exposed in an environment where refrigerant, lubricant oil and possible, relatively water and impurity, which improves the insulation of the compressor.

Compared with the current technology, the present disclosure has the following advantages.

1) Mechatronics is reached by disposing the motor mechanism, compression mechanism and electronic control device in a housing. A retaining wall of the housing is used to isolate a receiving chamber, for receiving the motor mechanism and compression mechanism, from the controller chamber.

2) A stable lubrication oil pool is formed in the interior of the compressor with the vertical structure. It is not difficult to reach the internal oil recycling and lubrication which will reduce the damages caused by interactions between the parts of the compressor.

3) The fixed scroll plate, made of aluminum alloy, with high wear resistance is adopted to be a portion of the housing of the compressor. The inlet opening and the exhaust opening of the compressor are formed on the fixed scroll plate which improve the air tightness of the compressor. Since the inlet opening and the exhaust opening of the compressor are formed on the fixed scroll plate with high wear resistance, the thread tooth for installing the suction plate and the exhaust plate are not easy to be damaged.

4) The shape of the compressor is similar to a cuboid. Under the premise of keeping the volume of the overall structure of the compressor unchanged, the installation space for the compressor in cuboid shape is smaller than the installation space of the cylindrical shape, and the utilization efficiency of the installation space is then improved.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

The invention claimed is:

1. A compressor, comprising:

a housing including a first opening to form a receiving space and a retaining wall, wherein the receiving space is divided, by the retaining wall, into a low-pressure chamber and a controller chamber;

a compressing mechanism comprising:

a fixed scroll plate including a low-pressure side of scroll wraps and a high-pressure side, opposite to the scroll wraps;

an orbiting scroll plate, located in the receiving space, including a side, facing the scroll wraps of the fixed scroll plate, of scroll wraps and a compression chamber is formed by the scroll wraps of the fixed scroll plate and the scroll wraps of the orbiting scroll plate;

an electrical machinery mechanism, located in the low-pressure chamber, including a rotor and a stator, wherein the electrical machinery mechanism drives the compressing mechanism to rotate to compress refrigerant in the compression chamber;

wherein the fixed scroll plate is made of forged aluminum alloy or extrusion casted aluminum alloy;

the compressor further comprises:

an upper cover including a high-pressure chamber formed between the upper cover and the high-pressure side of the fixed scroll plate and a suction chamber is formed on the low-pressure side of the fixed scroll plate;

wherein the fixed scroll plate includes an exhaust port connecting the high-pressure chamber and a suction port connecting the suction chamber;

wherein the compressor is a vertical compressor, the refrigerant flows into the vertical compressor via the suction port of the fixed scroll plate, and then flows away from the fixed scroll plate and towards a bottom wall of the housing, wherein the refrigerant flows by the retaining wall of the housing and cools down electrical controlling components inside the controller chamber and the refrigerant flows by the electrical machinery mechanism to cool down the electrical machinery mechanism;

wherein the refrigerant flows into the compression chamber formed between the fixed scroll plate and orbiting scroll plate.

2. The compressor of claim 1, wherein the low-pressure side of the fixed scroll plate is opposite to the first opening of the housing to form the receiving space and the shape of the receiving space is similar to a cuboid.

3. The compressor of claim 1, wherein the controller chamber comprises a second opening and the compressor further comprises a controller-chamber cover for sealing the second opening;

electrical control components located in the controller chamber, wherein the controller chamber is located between the controller-chamber cover and the retaining wall;

wherein, the retaining wall includes a reentrant facing the second opening of the controller chamber;

the electric controlling components comprises:

a first electric controlling component disposed in the reentrant;

a second electric controlling component and the retaining wall are disposed in a space being outside of the reentrant;

wherein, the first electric controlling component includes at least one of capacitors, inductors and relays;

the second electric controlling component includes power component patched with the retaining wall.

4. The compressor of claim 1, wherein the compressor further comprises:

an upper holder fixed with the low-pressure side of the fixed scroll plate;

a lower holder fixed to the upper holder via the stator.

5. The compressor of claim 4, wherein the upper holder includes a first side connected and fixed to the fixed scroll plate, and a second side opposite to the first side, wherein a plurality of upper-holder bosses are disposed on the second side of the upper holder and each of the upper-holder bosses includes a threaded hole;

wherein the stator includes a plurality of first bolt-through holes corresponding to the threaded holes and the lower holder includes a plurality of second bolt-through holes corresponding to the threaded holes;

bolts going through the second bolt-through holes, the first bolt-through holes and the threaded holes for fixing the upper holder, the stator and the lower holder.

6. The compressor of claim 5, wherein the compressor further comprises guide pillars and each of the bolts goes through a guide pillar, which allows the guiding pillar to be located between an inner wall of the first bolt-through holes of the stator and the bolt, wherein the guide pillar includes an end abutting the upper holder and the other end abutting the lower holder.

7. The compressor of claim 6, wherein an axial length of the guide pillars is greater than an axial length of the first bolt-through holes.

8. The compressor of claim 4, wherein bolts go through a through hole of the upper holder and a threaded hole of the fixed scroll plate, which allows the low-pressure side of the fixed scroll plate to connect and fix the upper holder.

9. The compressor of claim 4, wherein the stator is coupled to a binding post via a lead-out wire and the binding post, disposed between an inner wall of the housing and an outer wall of the stator, is located away from a bottom wall of the housing.

10. The compressor of claim 9, wherein the binding post is disposed on the fixed scroll plate.

11. The compressor of claim 10, wherein the binding post includes a pin and an end plate and the fixed scroll plate includes through holes which allows the pin of the binding post to go through and a groove, facing an opening of the electrical machinery mechanism, surrounding the through hole;

wherein the end plate, away from a surface of the electrical machinery mechanism, is contacted with a bottom wall of the groove.

* * * * *